US012247751B2

(12) United States Patent
Taras et al.

(10) Patent No.: US 12,247,751 B2
(45) Date of Patent: Mar. 11, 2025

(54) MULTIPLE FAN HVAC SYSTEM WITH OPTIMIZED FAN LOCATION

(71) Applicant: Goodman Manufacturing Company, L.P., Waller, TX (US)

(72) Inventors: Michael F Taras, The Woodlands, TX (US); Aniruddha S Joshi, Waller, TX (US); Amr E Gado, Waller, TX (US)

(73) Assignee: Goodman Manufacturing Company, L.P., Waller, TX (US)

( * ) Notice: Subject to any disclaimer, the term of this patent is extended or adjusted under 35 U.S.C. 154(b) by 408 days.

(21) Appl. No.: 17/575,253

(22) Filed: Jan. 13, 2022

(65) Prior Publication Data

US 2023/0221012 A1 Jul. 13, 2023

(51) Int. Cl.
*F24F 1/38* (2011.01)

(52) U.S. Cl.
CPC ..... *F24F 1/38* (2013.01); *F24F 2221/16* (2013.01)

(58) Field of Classification Search
CPC .. F24F 1/38; F24F 2221/16; F24F 1/16; F24F 1/022
USPC ..... 62/259.1
See application file for complete search history.

(56) References Cited

U.S. PATENT DOCUMENTS

| | | | | |
|---|---|---|---|---|
| 5,067,560 | A | 11/1991 | Carey et al. | |
| 7,014,423 | B2 | 3/2006 | Parker et al. | |
| 7,137,775 | B2 | 11/2006 | Hopkins | |
| 10,100,712 | B2 | 10/2018 | Baldus | |
| 10,928,117 | B2 | 2/2021 | Feng et al. | |
| 11,137,165 | B2 | 10/2021 | Gupte et al. | |
| 11,208,905 | B2 | 12/2021 | Bhosale et al. | |
| 2004/0020449 | A1 | 2/2004 | Stevens | |
| 2017/0130974 | A1 | 5/2017 | Mercer | |
| 2017/0248330 | A1* | 8/2017 | Nezu | F24F 1/50 |
| 2018/0372386 | A1 | 12/2018 | Cao | |
| 2020/0271332 | A1* | 8/2020 | Salunkhe | F24F 1/38 |
| 2021/0102715 | A1 | 4/2021 | Alvarez Cavazos et al. | |
| 2021/0164710 | A1 | 6/2021 | Karkhanis et al. | |

FOREIGN PATENT DOCUMENTS

| | | | |
|---|---|---|---|
| CA | 2593401 | A1 | 8/2006 |
| JP | 2006258326 | A | 9/2006 |
| JP | 2013011235 | A | 1/2013 |
| JP | 2016044939 | A | 4/2016 |
| JP | 2020038054 | A | 3/2020 |
| KR | 100607675 | B1 | 8/2006 |
| KR | 100762514 | B1 * | 10/2007 |
| KR | 20110091391 | A | 8/2011 |
| KR | 102133258 | B1 | 7/2020 |

OTHER PUBLICATIONS

International Search Report and Written Opinion dated May 4, 2023 for corresponding PCT Patent Application No. PCT/US2023/060286 filed on Jan. 9, 2023.
International Search Report and Written Opinion dated May 2, 2023 for related PCT Application No. PCT/US2023/060438 filed Jan. 11, 2023, 9 pages.

* cited by examiner

*Primary Examiner* — Steve S Tanenbaum
(74) *Attorney, Agent, or Firm* — K&L Gates LLP

(57) ABSTRACT

A heating, ventilation, and air-conditioning (HVAC) system that includes an outdoor heat exchanger (HX) and outdoor fans. The outdoor fans are arranged in either an in-line configuration or a staggered configuration to satisfy one or more requirements to optimize the airflow across the outdoor HXs.

27 Claims, 10 Drawing Sheets

MULTIPLE FAN HVAC SYSTEM WITH OPTIMIZED FAN LOCATION

BACKGROUND

This section is intended to provide relevant background information to facilitate a better understanding of the various aspects of the described embodiments. Accordingly, these statements are to be read in this light and not as admissions of prior art.

In general, heating, ventilation, and air-conditioning ("HVAC") systems circulate an indoor space's air over low-temperature (for cooling) or high-temperature (for heating) sources, thereby adjusting an indoor space's air temperature and humidity. HVAC systems generate these low- and high-temperature sources by, among other techniques, taking advantage of a well-known physical principle: a fluid transitioning from gas to liquid releases heat, while a fluid transitioning from liquid to gas absorbs heat.

Within a typical HVAC system, a fluid refrigerant circulates through a closed loop circuit of tubing that uses compressors and other flow-control devices to manipulate the refrigerant's flow and pressure, causing the refrigerant to cycle between the liquid and gas phases. Generally, these phase transitions occur within the HVAC's heat exchangers, which are part of the closed loop and designed to transfer heat between the circulating refrigerant and flowing ambient air or another secondary fluid. As would be expected, the heat exchanger providing heating or cooling to the climate-controlled space or structure is described as being "indoor," and the heat exchanger transferring heat with the surrounding outdoor environment is described as being "outdoor."

The refrigerant circulating between the indoor and outdoor heat exchangers, transitioning between phases along the way, absorbs heat from one location and releases it to the other. Those in the HVAC industry describe this cycle of absorbing and releasing heat as "pumping." To cool the climate-controlled indoor space, heat is "pumped" from the indoor side to the outdoor side, and the indoor space is heated by doing the opposite, pumping heat from the outdoors to the indoors.

In a cooling mode, a heat pump operates like a typical air conditioner, i.e., a refrigerant is compressed in a compressor and delivered to a condenser (or an outdoor heat exchanger). In the condenser, heat is exchanged between a medium such as outside air, water, or the like and the refrigerant. From the condenser, the refrigerant passes to an expansion device, at which the refrigerant is expanded to a lower pressure and temperature, and then to an evaporator (or an indoor heat exchanger). In the evaporator, heat is exchanged between the refrigerant and the indoor air, to condition the indoor air. When the refrigerant system is operating, the evaporator cools the air that is being supplied to the indoor environment. In addition, as the temperature of the indoor air is lowered, moisture usually is also taken out of the air. In this manner, the humidity level of the indoor air can also be controlled.

Reversible heat pumps work in either direction to provide heating or cooling to the internal space as mentioned above. Reversible heat pumps employ a reversing valve to reverse the flow of refrigerant from the compressor through the condenser and evaporator heat exchangers (HXs). In heating mode, the outdoor HX is an evaporator, while the indoor HX is a condenser. The refrigerant flowing from the evaporator (outdoor HX) carries the thermal energy from outside air (or other source such as water, soil, etc.) indoors. Vapor temperature is augmented within the pump (compressor) by compressing it. The indoor HX then transfers thermal energy (including the energy from compression) to the indoor air, which is then moved around the inside of the building by a blower or air handler. The refrigerant is then allowed to expand, cool, and absorb heat from the outdoor temperature in the outside evaporator, and the cycle repeats. This is a standard vapor compression refrigeration cycle, save that the "cold" side of the refrigerator (the evaporator HX) is positioned so it is outdoors where the environment is colder.

For both heating and cooling of indoor spaces, the performance of a typical HVAC system is affected by the efficiency of airflow across the outdoor HX. The refrigeration cycle uses a stream of airflow to effect thermal exchange between the refrigerant and the outside environment. This air is moved using "outdoor" fans to move air across the outdoor HX. The amount of air the fans can pass and the amount of power the fans consume affect the performance of the HVAC system. In concept, the more airflow provided by the fans, the more heat is transferred between the air and the refrigerant inside the outdoor HX. Typical ways to maximize airflow are to use bigger fan motors, bigger fans, fans with more blades, or different blade configurations. However, using bigger motors or fans leads to consuming more energy. Further, using fans with more blades or different configurations also has limitations on amount of air the fan can move.

In addition, the amount of air the fans can pass is affected by the location of the fans, with respect to both, each other and the outdoor HX. Being evenly spaced or centered is a common solution. However, this solution does not optimize the performance of the condenser. The speed and the amount of the air moved by a fan is typically the highest in front of the fan and slows down away from the fan. Therefore, depending on what is next to or around the fan, be it the HX, or sheet metal panels, or other fans, the speed of the air, and therefore the amount of air moved, will be higher in some configurations than others. Additionally, the airflow distribution over the outdoor HX face area has to be taken into account, which is also affected by the fan system configuration and targeted positioning, as well as the design space constraints.

BRIEF DESCRIPTION OF THE DRAWINGS

Embodiments of the multiple fan HVAC system with optimized fan location are described with reference to the following figures. The same or sequentially similar numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
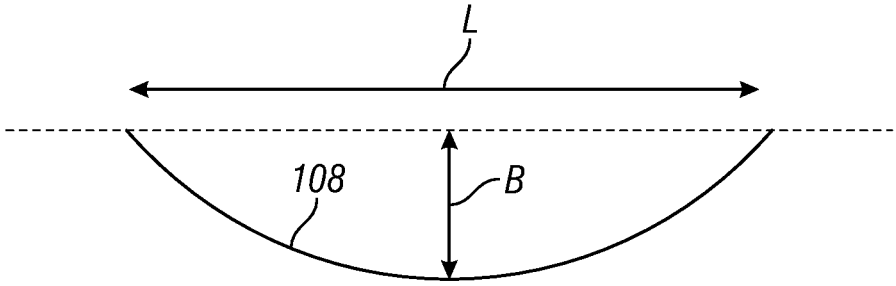
FIG. 1 is a schematic illustration of a top edge of a formed outdoor heat exchanger, according to at least one embodiment.

The present disclosure describes a heating, ventilation, and air-conditioning (HVAC) system with multiple outdoor fans for moving ambient air across one or more outdoor heat exchangers (HXs) of the HVAC system. The HVAC system may be a variable refrigerant flow system with variable speed outdoor fans. There may be one, two, or more outdoor HXs that each include a length or projected length across the top of the HXs across two ends as well as a projection onto the plane of the top of the HVAC system. The outdoor HX may be planar or formed (bent in an arc or other shape). Even if formed, the outdoor HX includes ends and the length L across the top of the outdoor HX is still the straight line length from one end to the other. For example, in FIG. 1, a plane of a formed outdoor HX 108 is shown. Although curved, the outdoor HX 108 includes two ends and the length L is the straight line length from one end to the other. The depth of the curve is represented by the arrow B.

Figure 2:
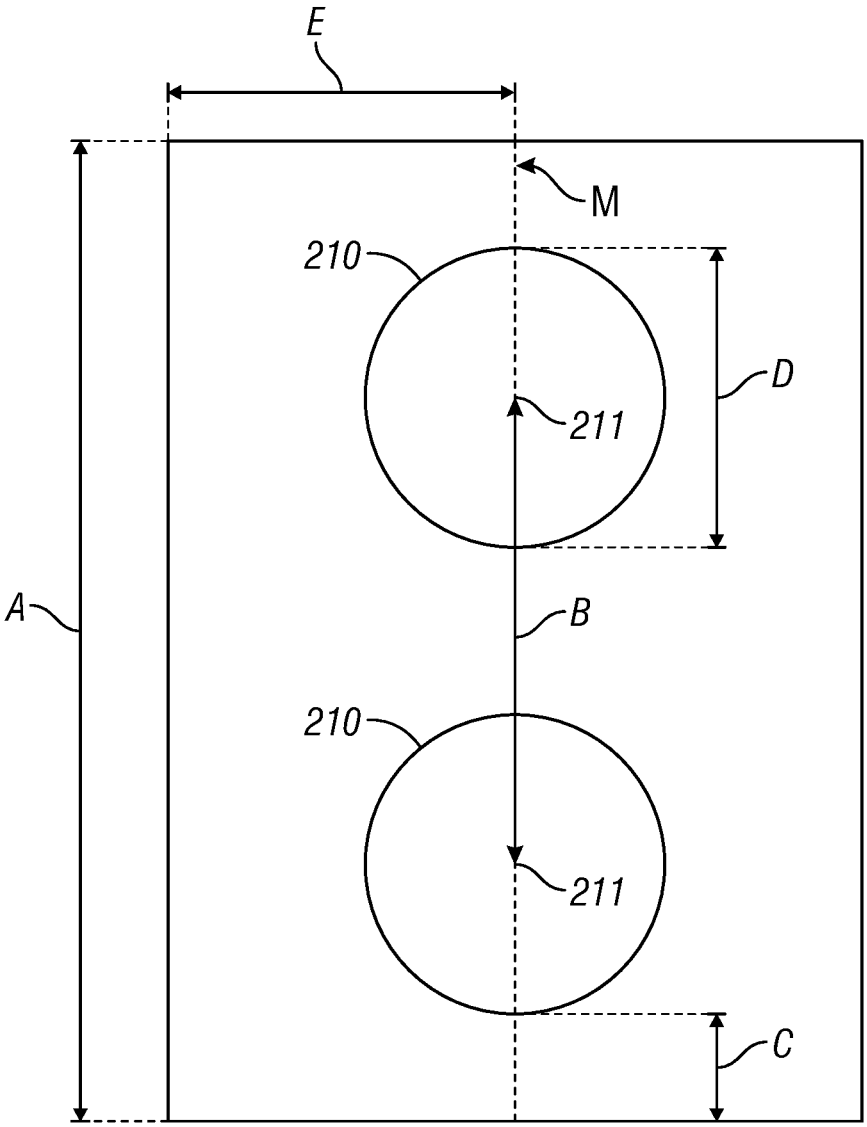
FIG. 2 is a schematic illustration of a top surface of an outdoor section of a heating ventilation and air conditioning (HVAC) system, according to at least one embodiment.

The number of outdoor fans depends on the length of each outdoor HX, the number and arrangement of the outdoor HXs, fan design and size, design space constraints, and the desired airflow across the outdoor HXs. For example, the HVAC system can include two, three, four, five, six, or more outdoor fans. The outdoor fans are arranged by being spaced in one of two configurations, in-line or staggered. For the in-line configuration, the outdoor fans are spaced in a plane parallel with the length of an outdoor HX in a single group. For example, the in-line configuration may include groups of two, three, four, or six outdoor fans. For reference, FIG. 2 illustrates two outdoor fans 210 spaced in a plane M parallel with the length of an outdoor HX running along a length A. The outdoor HX (not shown) also includes a projection E, which is the distance from the bottom to the top of the outdoor HX in a "horizontal" plane across the top of the HVAC system. In the example diagram shown in FIG. 2, the projection E is for one of two outdoor HXs arranged in a "V" configuration below the fans. There would be another projection length for the second outdoor HX. The outdoor fans 210 also include centers 211 and a distance B between the centers of the outdoor fans 210. The outdoor fans 210 also include diameters D, which as shown are the same but may be different diameters as well. The outdoor fans 210 also include perimeters around the outer edges of the outdoor fans 210 such that there is a distance C between the side edge of the outdoor HX to the perimeter of the outdoor fan(s) closest to the edge. The outdoor fans on a plane are considered a group and there may be more than one plane and thus more than one group.

For the in-line configuration shown in FIG. 2, the outdoor fans 210 in a group are arranged to satisfy at least one of the following conditions: a ratio of the distance between the centers of the outdoor fans to the largest diameter of the fans is from 1.3 to 2.1, a ratio of the largest diameter of the fans to the projection is from 0.5 to 0.95, or the ratio of a distance between the perimeter of a fan and an edge of the outdoor HX and the length of the coil is from 0.05 to 0.3.

Figure 3:
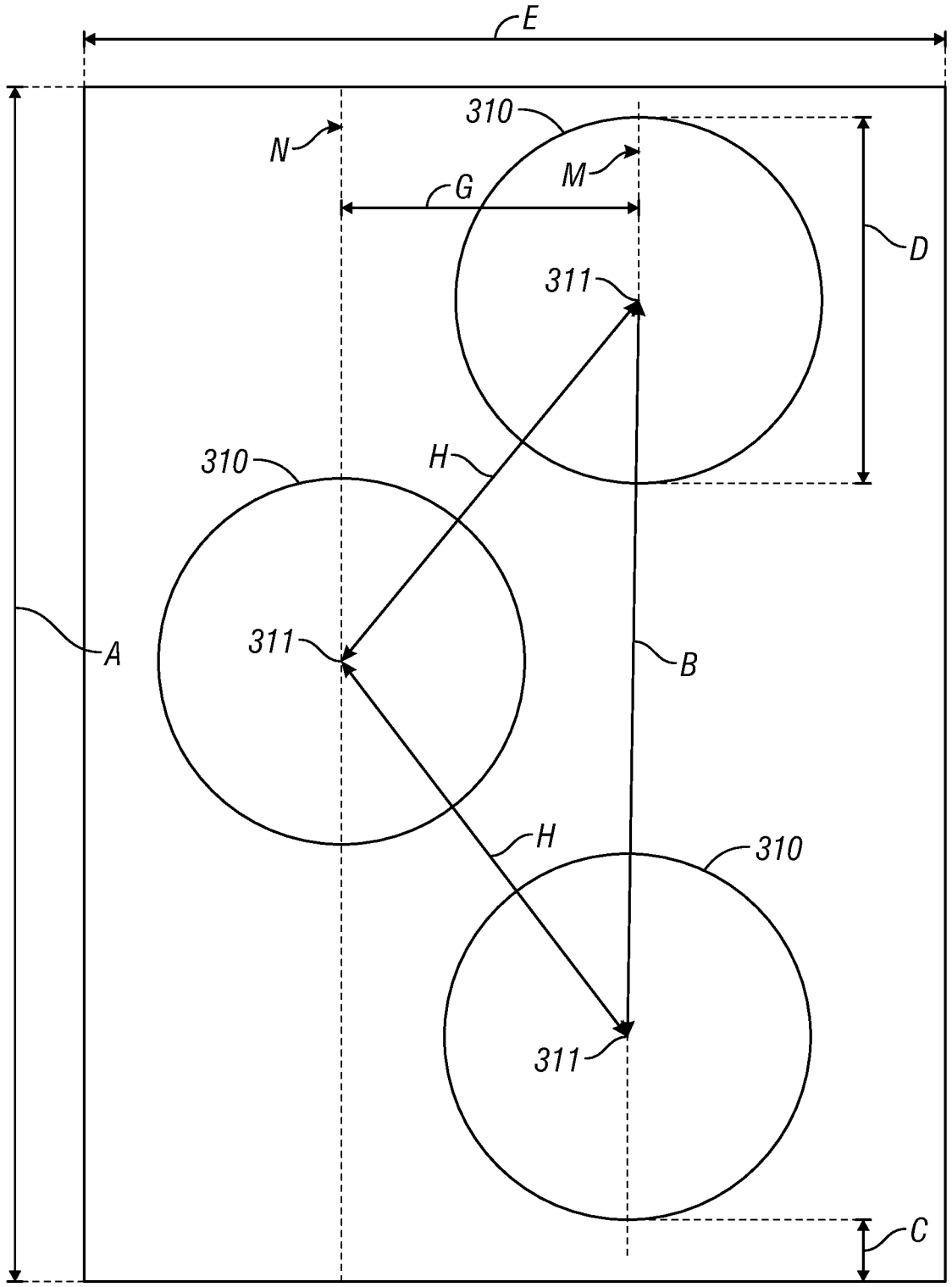
FIG. 3 is a schematic illustration of a top surface of another outdoor section of an HVAC system, according to at least one embodiment.

For the staggered configuration, the outdoor fans are spaced in a staggered configuration relative to two planes parallel with the length of the outdoor HX spaced by a separation distance. The difference between multiple in-line groups and a staggered configuration is that in a staggered configuration the centers of at least two of the outdoor fans on different planes are offset with respect to the direction of projection E. For reference, FIG. 3 illustrates three outdoor fans 310 that are arranged in two planes M and N parallel with the length A of the outdoor HX underneath the fans 310 (not shown) and separated by a separation distance G. In addition to the distance between the centers 311 of the outdoor fans 310 on the same plane M, there is also a distance between centers 311 of any outdoor fan 310 on plane M to the center 311 of any outdoor fan 310 on plane N. Although shown the same size, the outdoor fans 310 may have different diameters D. Additionally, as an example, the staggered configuration may include three or five outdoor fans.

For the staggered configuration shown in FIG. 3, the outdoor fans 310 are arranged to satisfy at least one of the following conditions: a ratio of the distance between the centers of the outdoor fans on one of the planes to the largest diameter of the fans is from 1.3 to 2.1, the ratio of the distance between the centers of the outdoor fans on one of the planes to the length of the outdoor HX is from 1.5 to 2.1, a ratio of the separation distance to the projection is between zero and 0.45, or a ratio of the distance between the center of any outdoor fan on one plane and the center of any outdoor fan on the other plane to the distance between the centers of the outdoor fans on the same plane is from 0.5 to 1.

Figure 4:
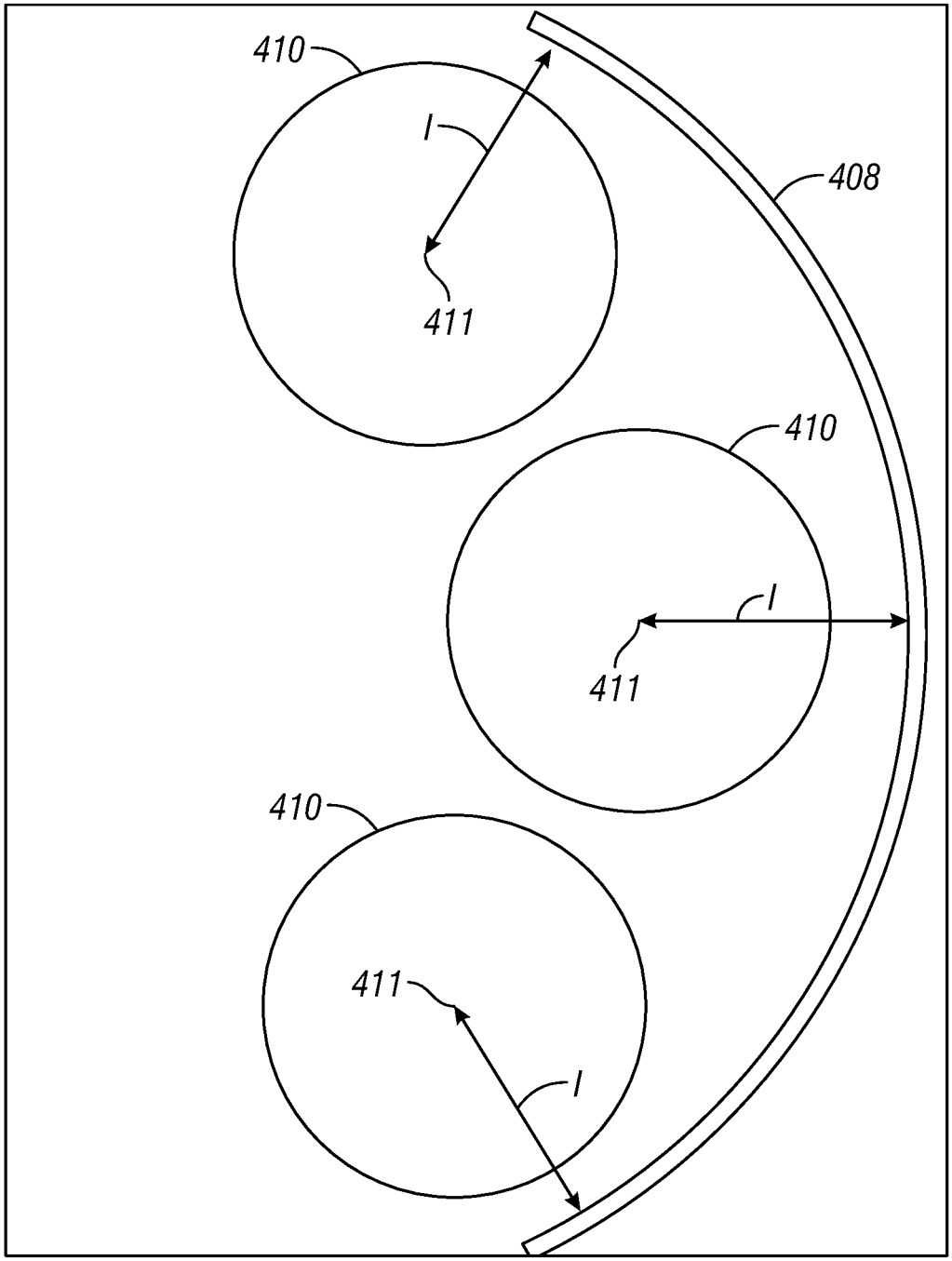
FIG. 4 is a schematic illustration of a top surface of another outdoor section of an HVAC system, according to at least one embodiment.

An alternative staggered configuration is shown in FIG. 4 where the outdoor fans are arranged with respect to a formed outdoor HX with a top edge in the shape of an arc. In additional to satisfying at least one of the staggered configuration discussed above in FIG. 3, in this configuration each outdoor fan 410 is arranged such that the ratio of the shortest distance and the longest distance I between the centers 111 of the outdoor fans 110 and the arc of the outdoor HX 408 is between 0.75 and 1.

The HVAC system can include two or more outdoor HXs and two, three, four, five, six, or more outdoor fans arranged in groups associated with a particular outdoor HX with the outdoor fans of each group arranged to satisfy at least one of the conditions of either the in-line or staggered arrangement.

Figure 5:
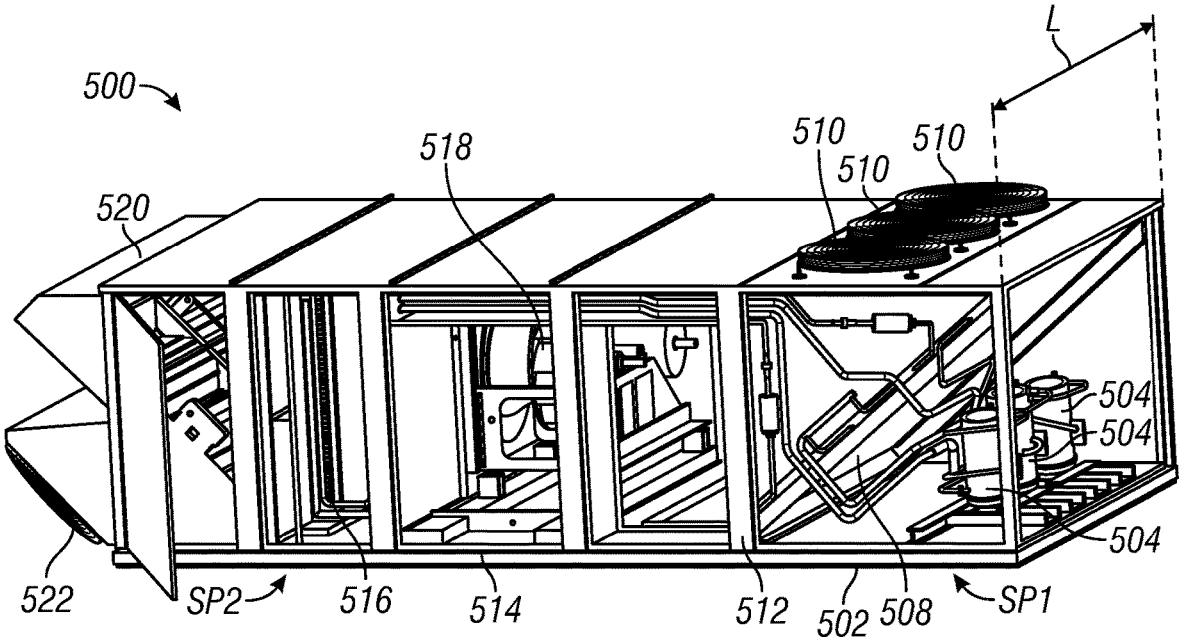
FIG. 5 is an isometric view of an HVAC system, according to at least one embodiment.

Turning now the figures, FIG. 5 is an isometric view of an HVAC system 500 according to at least one embodiment seen from obliquely above the HVAC system 500. Although not shown, it should be appreciated that the HVAC system 500 includes additional panel covers for covering and protecting the equipment of the HVAC system 500. The example HVAC system 500 shown is a so-called "light" commercial packaged rooftop unit and shall be described in terms of a cooling operation, although it should be appreciated that the HVAC system 500 could also be a heat pump and used for heating and can be representing residential packaged, residential split, light commercial split, or commercial applied applications. The HVAC system 500 may be a variable refrigerant flow system with variable speed outdoor fans 510. The HVAC system 500 includes both an "outdoor" section SP1 and an "indoor" section SP2 mounted on a common frame 502.

The outdoor section SP1 includes one or more compressors 504. As noted above, the outdoor section SP1 may include other HVAC system components, such accumulators, receivers, charge compensators, flow control devices, air movers, pumps, and filter driers. Also included, is an outdoor HX 508 and three outdoor fans 510 that move air across the outdoor HX 508 and to the outside of the HVAC system 500. Although FIG. 5 shows one outdoor HX 508 and three outdoor fans 510, the conditions discussed for the placement of the outdoor fans 510 apply to other numbers and groupings of fans and HXs as will be discussed in other embodiments below.

The outdoor fans 510 may be any suitable type of fan, for example, a propeller fan. The outdoor fans 510 may be of any suitable size for conforming to the placement conditions discussed below. The outdoor fans 510 may also include any suitable configuration of blade number, size, angle, and shape. The outdoor fans 510 may also be driven electrically or mechanically. The outdoor fans 510 may be identical to each other or at least one of the outdoor fans may have a parameter that is different from at least one other outdoor fan. The parameter may include, but is not limited to, diameter, number of blades, blade design, fan motor size, and fan type. Each outdoor fan includes a center, a diameter, a radius, and a perimeter defined by the outer edge of the outdoor fans as discussed above.

The outdoor HX 508 is a planar or formed HX and includes a straight line length L across the top of the outdoor HX 508 from one end to the other. The outdoor HX 508 is shown as planar. However, it should be appreciated that the outdoor HX may also be formed (bent in an arc or other shape). As discussed above, even if formed, the outdoor HX includes ends and the length L across the top of the outdoor HX is still the straight line length from one end to the other. The outdoor HX also includes a projection, which is the distance from the bottom to the top of the outdoor HX in a "horizontal" plane across the top of the HVAC system 500 as discussed above.

The outdoor HX 508 may include a plurality of heat-transfer tubes (not shown) through which a refrigerant flows and a plurality of heat-transfer fins (not shown) in which air flows between gaps thereof. The plurality of heat-transfer tubes may be arranged in an up-down direction (hereunder may be referred to as "row direction"), and each heat-transfer tube may extend in a direction substantially orthogonal to the up-down direction (in a substantially horizontal direction). At an end portion of the outdoor HX 508, for example, the heat-transfer tubes are connected to each other by being bent into a U-shape or by using a U-shaped return bends so that the flow of a refrigerant from a certain column to another column and/or a certain row to another row is turned back. The plurality of heat-transfer fins that extend so as to be oriented in the up-down direction are arranged side by side in a direction in which the heat-transfer tubes extend with a predetermined interval between the plurality of heat-transfer fins. The plurality of heat-transfer fins and the plurality of heat-transfer tubes are assembled to each other so that each heat-transfer fin extends through the plurality of heat-transfer tubes. The plurality of heat-transfer fins are also disposed in a plurality of columns. Although the outdoor HX is described as a round tube and plate fin HX, other heat exchanger types, such as for instance microchannel HX, are also within the scope of the disclosure.

Due to the structure of the outdoor HX 508, a flow path of outdoor air that enters the outdoor section SP1 passes through the outdoor HX 508, where the outdoor air exchanges thermal energy with a refrigerant that flows in a refrigerant circuit through the outdoor HX 508. After the thermal energy exchange in the outdoor HX 508, the air is discharged to the outside of the outdoor section SP1 by the outdoor fans 510. The efficiency of the exchange of thermal energy between the refrigerant flowing through the outdoor HX 508 and the ambient air, and thus the performance of the HVAC system 500, is affected by the rate of airflow across the outdoor HX. The amount of air the outdoor fans 510 can pass and the amount of power the outdoor fans 510 consume affect the performance of the HVAC system.

To optimize performance, airflow across the outdoor HX 508 should be maximized for a given number of outdoor fans 510 of a given size and power consumption profile. Airflow across the outdoor HX 508 in this embodiment is maximized with the outdoor fans 510 spaced in a plane predominantly parallel with the length L of the outdoor HX 508 to satisfy at least one of the following conditions: a ratio of the distance between the centers of the outdoor fans to the largest diameter of the fans is from 1.3 to 2.1, a ratio of the largest diameter of the fans to the projection is from 0.5 to 0.95, or the ratio of a distance between the perimeter of a fan and an edge of the outdoor HX and the length of the coil is from 0.05 to 0.3. While meeting any one of these conditions is beneficial, meeting as many as possible or all of the conditions would be optimal in maximizing the airflow across, and thus the thermal energy exchange with, the outdoor HX 508. The benefit is to obtain better airflow from existing fans without increasing energy consumption. "Better airflow" means more airflow or distributed in a way that better matches the needs of the outdoor HX 508. This in turn leads to better efficiency for the HVAC system 500.

The outdoor section SP1 and the indoor section SP2 are separated by a partition plate 512. Outdoor air flows to the outdoor section SP1 and indoor air from the structure being cooled or heated flows to the indoor section SP2. In an ordinary state, the indoor air and the outdoor air do not mix and do not communicate with each other within or via the HVAC system 500. It is noted that there optionally exist the airside economizers that allow mixing indoor and outdoor air, however such economizers are not reviewed in relation to this discussion. Although not shown, the outdoor section SP1 includes an expansion device for expansion of the refrigerant from a high pressure to low pressure, for example, a thermostatic expansion valve (TXV) or electronic expansion valve (EXV). The expansion device may alternatively be located in the indoor section SP2.

The indoor section SP2 also includes an indoor HX 516 and an indoor blower 518, which may be, for example, a centrifugal fan. The indoor HX 516 may also include a plurality of heat-transfer tubes through which a refrigerant flows, and a plurality of heat-transfer fins in which air flows between gaps thereof. The plurality of heat-transfer tubes may be arranged in an up-down direction (row direction), and each heat-transfer tube may extend in a direction substantially orthogonal to the up-down direction (in the second embodiment, in a left-right direction). At an end portion of the indoor HX 516, for example, the heat-transfer tubes are connected to each other by being bent into a U-shape or by using a U-shaped return bends so that the flow of a refrigerant from a certain column to another column and/or a certain row to another row is turned back. The plurality of heat-transfer fins and the plurality of heat-transfer tubes may be assembled so that each heat-transfer fin extends through the plurality of heat-transfer tubes. Although the indoor HX 516 is described as a round tube and plate fin HX, other heat exchanger types, such as for instance microchannel HX, are also within the scope of the disclosure.

The indoor HX 516 divides the indoor section SP2 into a space on an upstream side with respect to the indoor HX 516 and a space on a downstream side with respect to the indoor HX 516. Air that flows to the downstream side from the upstream side with respect to the indoor HX 516 passes through the indoor HX 516. The indoor blower 518 is disposed in the space on the downstream side with respect to the indoor HX 516 and generates an airflow that passes through the indoor HX 516. Although not shown, a supply air duct is connected to the indoor section SP2 through a bottom plate 514 in the bottom of the HVAC system 500 (note that the side air supply and discharge are also feasible). Alternatively, the horizontal, instead of downward, supply and return air ducts can be provided, and the down-shot air duct configurations are also within the scope of the disclosure. The blower 518 is disposed above a supply air opening in the bottom plate 514 for providing supply air to the indoor space being conditioned. The HVAC system 500 may draw in ambient air to be conditioned through vent hood 520 that may optionally include louvered doors. The bottom plate 514 may also include a return air opening that provides return air from the indoor space being conditioned to either flow through the indoor HX 516 and the indoor blower 518 again or be expelled to the outside environment through indoor fans 522.

The HVAC system 500 also includes a refrigerant circuit that includes the indoor HX 516 and the outdoor HX 508 and in which a refrigerant circulates between the indoor HX 516 and the outdoor HX 508. In the refrigerant circuit, the refrigerant goes through a vapor compression refrigeration cycle and thermal energy is exchanged at the indoor HX 516 and the outdoor HX 508 between the refrigerant and the air outside the HXs. The refrigerant circuit includes the compressors 504, the outdoor HX 508, the expansion device, and the indoor HX 516. When operating to cool the indoor air, the refrigerant is compressed by the compressor(s) 504 and is sent to the outdoor HX 508. The refrigerant exchanges thermal energy to outdoor air at the outdoor HX 508 and is then sent to the expansion device. At the expansion device, the refrigerant expands and its pressure and temperature are reduced. The refrigerant is then sent to the indoor HX 516, where the low temperature, low-pressure refrigerant exchanges thermal energy with the ambient air. The indoor air is cooled by having thermal energy absorbed by the refrigerant in the indoor HX and is supplied to the indoor space being conditioned. The vapor refrigerant after the heat exchange at the indoor HX 516 is then sucked into the compressor(s) 504 to repeat the cycle.

The equipment of the refrigerant circuit, and thus flow of the refrigerant through the circuit may be controlled by a main controller that controls the HVAC system 500, which is discussed in further detail below. The main controller may also be capable of communicating with a remote controller. A user can send, for example, set values for indoor temperatures of rooms in the indoor space being conditioned to the main controller from the remote controller. For controlling the HVAC system 500, a plurality of temperature sensors for measuring the temperature of a refrigerant at each portion of the refrigerant circuit and/or a pressure sensor that measures the pressure of each portion and a temperature sensor for measuring the air temperature of each location may be provided.

The main controller performs at least on/off control of the compressors 504, on/off control of the outdoor fans 510, and on/off control of the indoor blowers 518. When any or all of the compressors 504, the outdoor fans 510, and the indoor blowers 518 include a motor of a type whose speed is changeable, the main controller may be configured to control the speed of the motor or motors. In this case, the main controller can control the circulation amount of the refrigerant that flows through the refrigerant circuit by changing the operation of the motor of the compressors 504. The main controller can change the flow rate of outdoor air that flows between the heat-transfer fins of the outdoor HX 508 by changing the speed of the motor of the outdoor fans 510. The main controller can change the flow rate of indoor air that flows between the heat-transfer fins of the indoor HX 516 by changing the speed of the motor of the indoor blowers 518.

Figure 6:
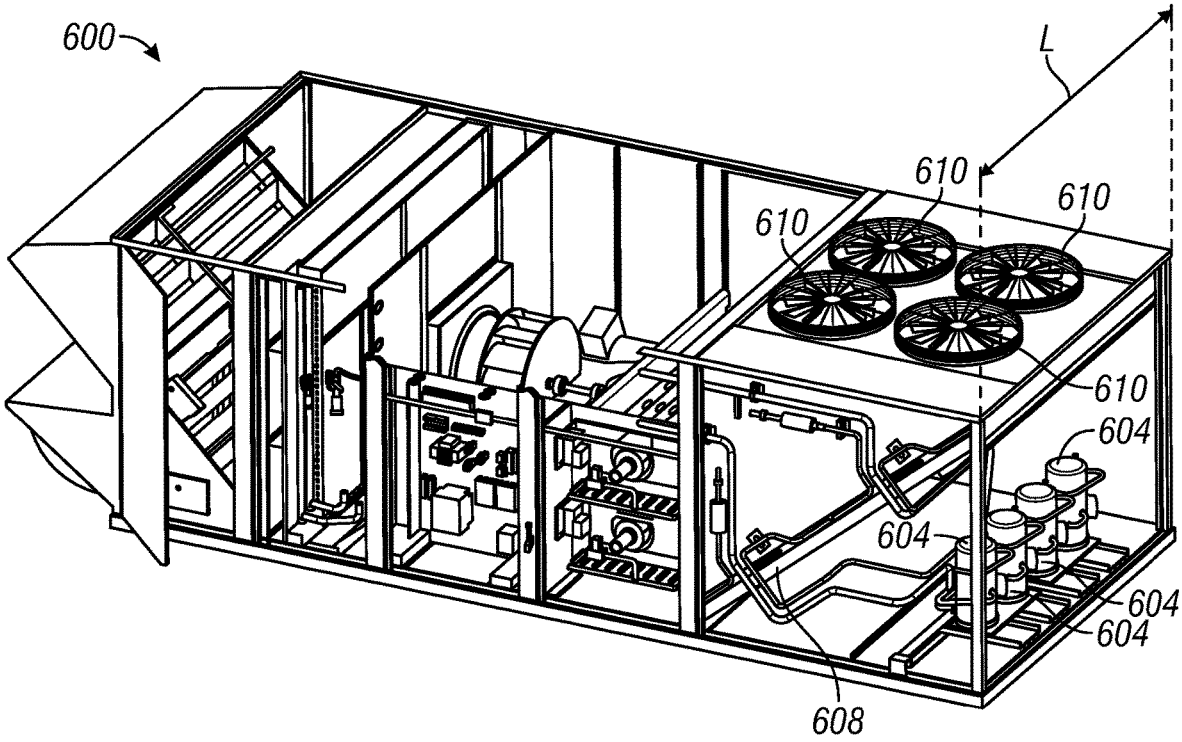
FIG. 6 is an isometric view of another HVAC system, according to at least one embodiment.

FIG. 6 illustrates another HVAC system 600, according to at least one embodiment. As shown, the HVAC system 600 includes components and operates similarly to the HVAC system 500 discussed from FIG. 5. As such, discussion of similar components and operation will not be repeated. Compared to FIG. 5, FIG. 6 illustrates four outdoor fans 610 in an alternative arrangement and four compressors 604 instead of three. The inclusion of more outdoor fans 610 and compressors 604 is a matter of designing the HVAC system 600 to operate under the anticipated operation loads and reflects the concept mentioned above that the HVAC system 600 can have different numbers and arrangements of outdoor fans 610 and compressors 604. The HVAC system 600 also illustrates that the outdoor fans 610 can be arranged in two groups of an in-line arrangement with respect to the projection of the outdoor HX 608, with the outdoor fans 610 in each group arranged to satisfy at least one of the following conditions: a ratio of the distance between the centers of the outdoor fans to the largest diameter of the fans is from 1.3 to 2.1, a ratio of the largest diameter of the fans to the projection is from 0.5 to 0.95, or the ratio of a distance between the perimeter of a fan and an edge of the outdoor HX and the length of the coil is from 0.05 to 0.3. While meeting any one of these conditions is beneficial, meeting as many as possible or all of the conditions would be optimal in maximizing the airflow across, and thus the thermal energy exchange with, the outdoor HX 608.

Figure 7:
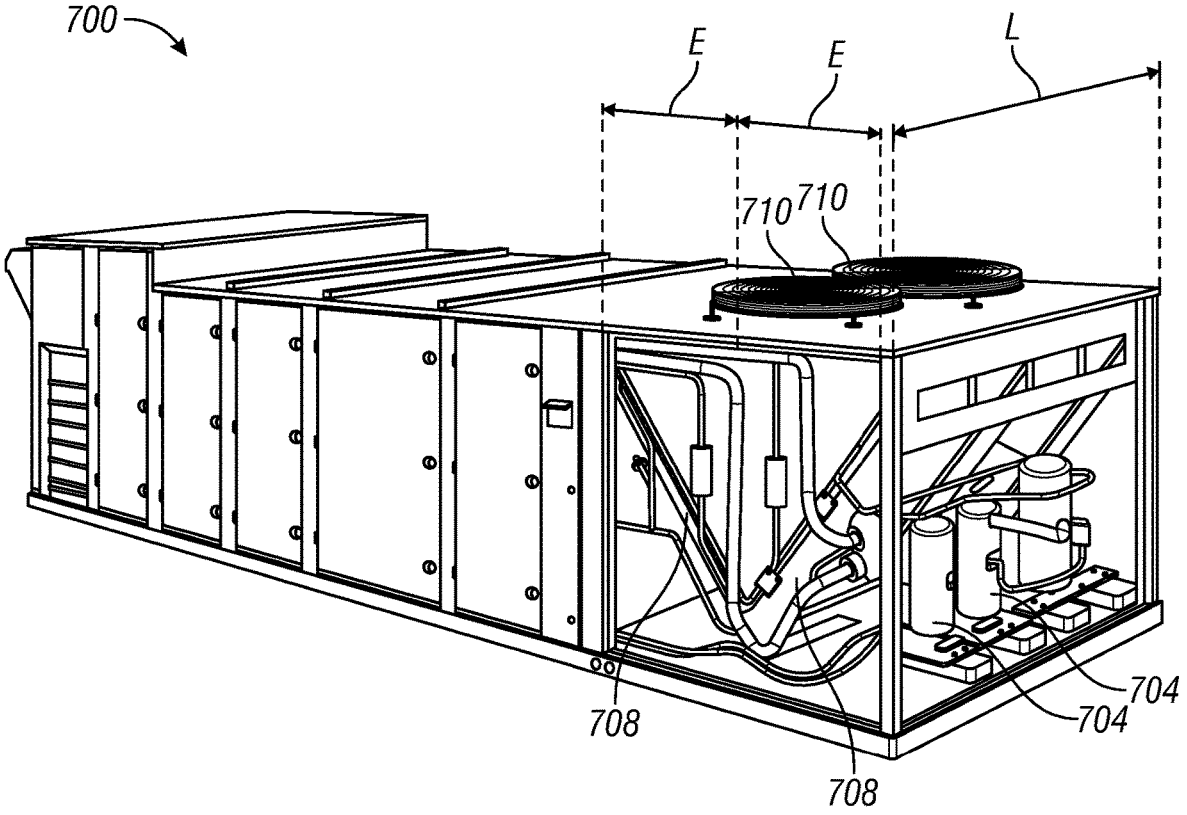
FIG. 7 is a perspective view of another HVAC system, according to at least one embodiment.

FIG. 7 illustrates another HVAC system 700, according to at least one embodiment. Although some components are enclosed and not visible, the HVAC system 700 includes components and operates similarly to the HVAC system 500 discussed from FIG. 5. As such, discussion of similar components and operation will not be repeated. Compared to FIG. 5, FIG. 7 illustrates two outdoor fans 710 instead of three and two compressors 704 instead of three. The inclusion of less outdoor fans 710 and compressors 704 is a matter of designing the HVAC system 700 to operate under the anticipated operation loads and reflects the concept mentioned above that the HVAC system 700 can have different numbers and arrangements of outdoor fans 710 and compressors 704. Further, instead of one outdoor HX, the HVAC system 700 includes two outdoor HXs 708, each with a length L and a projection E. Although not required, the outdoors HXs 708 angle toward each other to be arranged in a V-shape as mentioned above with respect to FIG. 2. The HVAC system 700 illustrates that, even with two outdoor HXs 708, the outdoor fans 710 are arranged to satisfy at least one of the following conditions: a ratio of the distance between the centers of the outdoor fans to the largest diameter of the fans is from 1.3 to 2.1, a ratio of the largest diameter of the fans to the projection is from 0.5 to 0.95, or the ratio of a distance between the perimeter of a fan and an edge of the outdoor HX and the length of the coil is from 0.05 to 0.3. While meeting any one of these conditions is beneficial, meeting as many as possible or all of the conditions would be optimal in maximizing the airflow across, and thus the thermal energy exchange with, the outdoor HXs 708.

Figure 8:
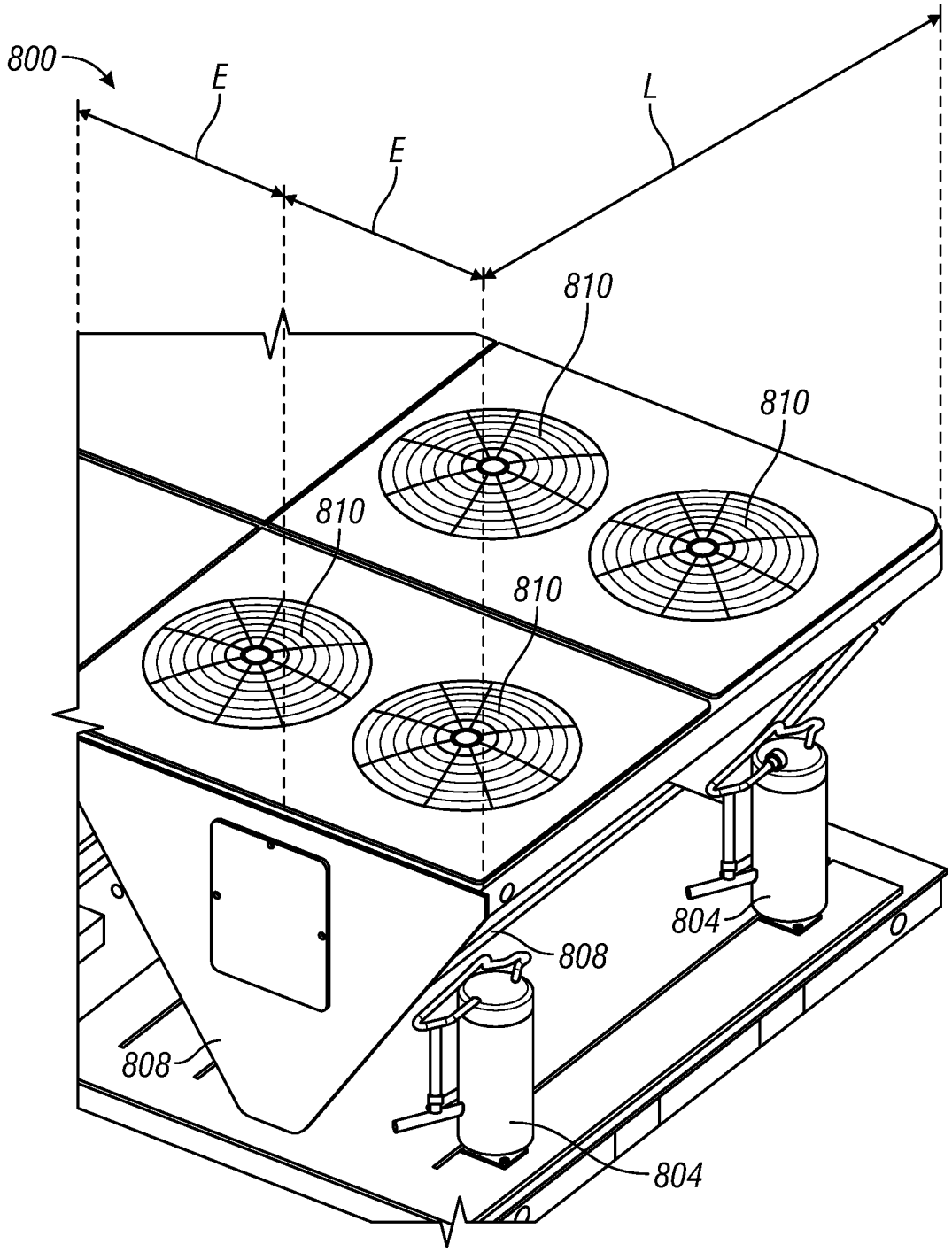
FIG. 8 is a pal perspective view of another HVAC system, according to at least one embodiment.

FIG. 8 illustrates a partial view of another HVAC system 800, according to at least one embodiment. Although some components are enclosed and not visible, the HVAC system 800 includes components and operates similarly to the HVAC system 500 discussed from FIG. 5. As such, discussion of similar components and operation will not be repeated. Compared to FIG. 5, FIG. 8 illustrates four outdoor fans 810 in two groups of an in-line arrangement instead of three in a row and two compressors 804 instead of three. The inclusion of more outdoor fans 810 and less compressors 804 is a matter of designing the HVAC system 800 to operate under the anticipated operation loads and reflects the concept mentioned above that the HVAC system 800 can have different numbers and arrangements of outdoor fans 410 and compressors 804. Further, instead of one outdoor HX, the HVAC system 800 includes two outdoor HXs 808, each with a length L and a projection E. Although not required, the outdoors HXs 808 angle toward each other to be arranged in a V-shape. The HVAC system 800 illustrates that, even with two outdoor HXs 808, the outdoor fans 810 can be arranged in a staggered configuration with respect to the projections E of the outdoor HXs 808 with the outdoor fans 810 in each group arranged in a plane parallel with the length L and arranged to satisfy at least one of the following conditions: a ratio of the distance between the centers of the outdoor fans to the largest diameter of the fans is from 1.3 to 2.1, a ratio of the largest diameter of the fans to the projection is from 0.5 to 0.95, or the ratio of a distance between the perimeter of a fan and an edge of the outdoor HX and the length of the coil is from 0.05 to 0.3. While meeting any one of these conditions is beneficial, meeting as many as possible or all of the conditions would be optimal in maximizing the airflow across, and thus the thermal energy exchange with, the outdoor HXs 808.

Figure 9:
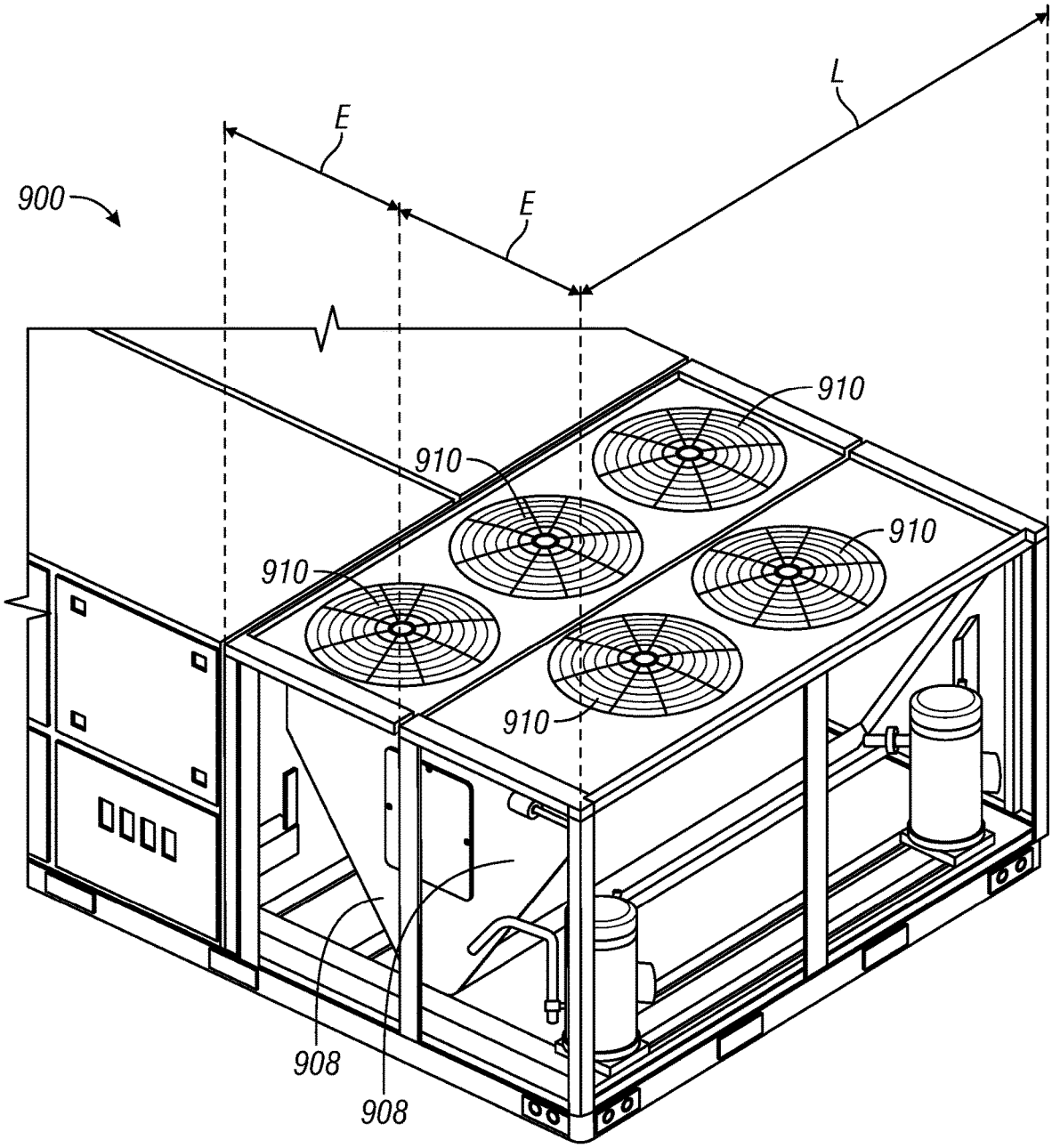
FIG. 9 is a perspective view of another HVAC system, according to at least one embodiment.

FIG. 9 illustrates a perspective view of another HVAC system 900, according to at least one embodiment. Although some components are enclosed and not visible, the HVAC system 900 includes components and operates similarly to the HVAC system 500 discussed from FIG. 5. As such, discussion of similar components and operation will not be repeated. Compared to FIG. 5, FIG. 9 illustrates five outdoor fans 910 in a staggered arrangement instead of an in-line arrangement. The inclusion of more outdoor fans 910 is a matter of designing the HVAC system 900 to operate under the anticipated operation loads and reflects the concept mentioned above that the HVAC system 900 can have different numbers and arrangements of outdoor fans 910. Further, instead of one outdoor HX, the HVAC system 900 includes two outdoor HXs 908, each with a length L and a projection E. Although not required, the outdoors HXs 908 angle toward each other to be arranged in a V-shape. The HVAC system 900 illustrates that, even with two outdoor HXs 908, the outdoor fans 910 can be arranged in a staggered configuration with respect to the projections E of the outdoor HXs 908 with the outdoor fans 910 arranged in planes parallel with the length L and arranged to satisfy at least one of the following conditions: a ratio of the distance between the centers of the outdoor fans on one of the planes to the largest diameter of the fans is from 1.3 to 2.1, the ratio of the distance between the centers of the outdoor fans on one of the planes to the length of the outdoor HX is from 1.5 to 2.1, a ratio of the separation distance to the projection is between zero and 0.45, or a ratio of the distance between the center of any outdoor fan on one plane and the center of any outdoor fan on the other plane to the distance between the centers of the outdoor fans on the same plane is from 0.5 to 1. While meeting any one of these conditions is beneficial, meeting as many as possible or all of the conditions would be optimal in maximizing the airflow across, and thus the thermal energy exchange with, the outdoor HXs 908.

Figure 10:
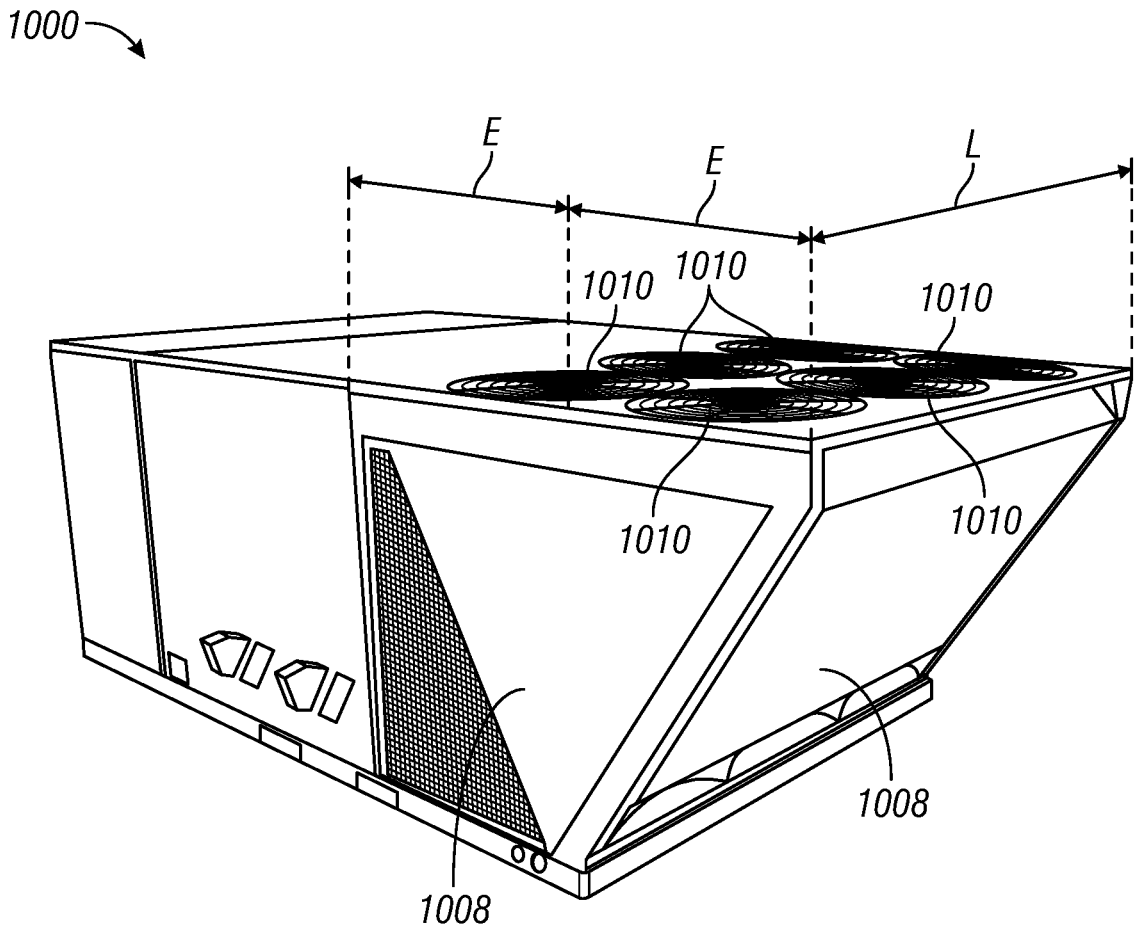
FIG. 10 is a perspective view of another HVAC system, according to at least one embodiment.

FIG. 10 illustrates a perspective view of another HVAC system 1000, according to at least one embodiment. Although some components are enclosed and not visible, the HVAC system 1000 includes components and operates similarly to the HVAC system 500 discussed from FIG. 5. As such, discussion of similar components and operation will not be repeated. Compared to FIG. 5, FIG. 10 illustrates six outdoor fans 1010 in two groups of an in-line arrangement. The inclusion of more outdoor fans 1010 is a matter of designing the HVAC system 1000 to operate under the anticipated operation loads and reflects the concept mentioned above that the HVAC system 1000 can have different numbers and arrangements of outdoor fans 1010. Further, instead of one outdoor HX, the HVAC system 1000 includes two outdoor HXs 1008, each with a length L and a projection E. Although not required, the outdoors HXs 1008 angle toward each other to be arranged in a V-shape. The HVAC system 1000 illustrates that, even with two outdoor HXs 1008, the outdoor fans 1010 can be arranged in an in-line arrangement with respect to the projections E of the outdoor HXs 1008 with the outdoor fans 1010 arranged in planes parallel with the length L and arranged to satisfy at least one of the following conditions: a ratio of the distance between the centers of the outdoor fans to the largest diameter of the fans is from 1.3 to 2.1, a ratio of the largest diameter of the fans to the projection is from 0.5 to 0.95, or the ratio of a distance between the perimeter of a fan and an edge of the outdoor HX and the length of the coil is from 0.05 to 0.3. While meeting any one of these conditions is beneficial, meeting as many as possible or all of the conditions would be optimal in maximizing the airflow across, and thus the thermal energy exchange with, the outdoor HXs 1008.

Figure 11:
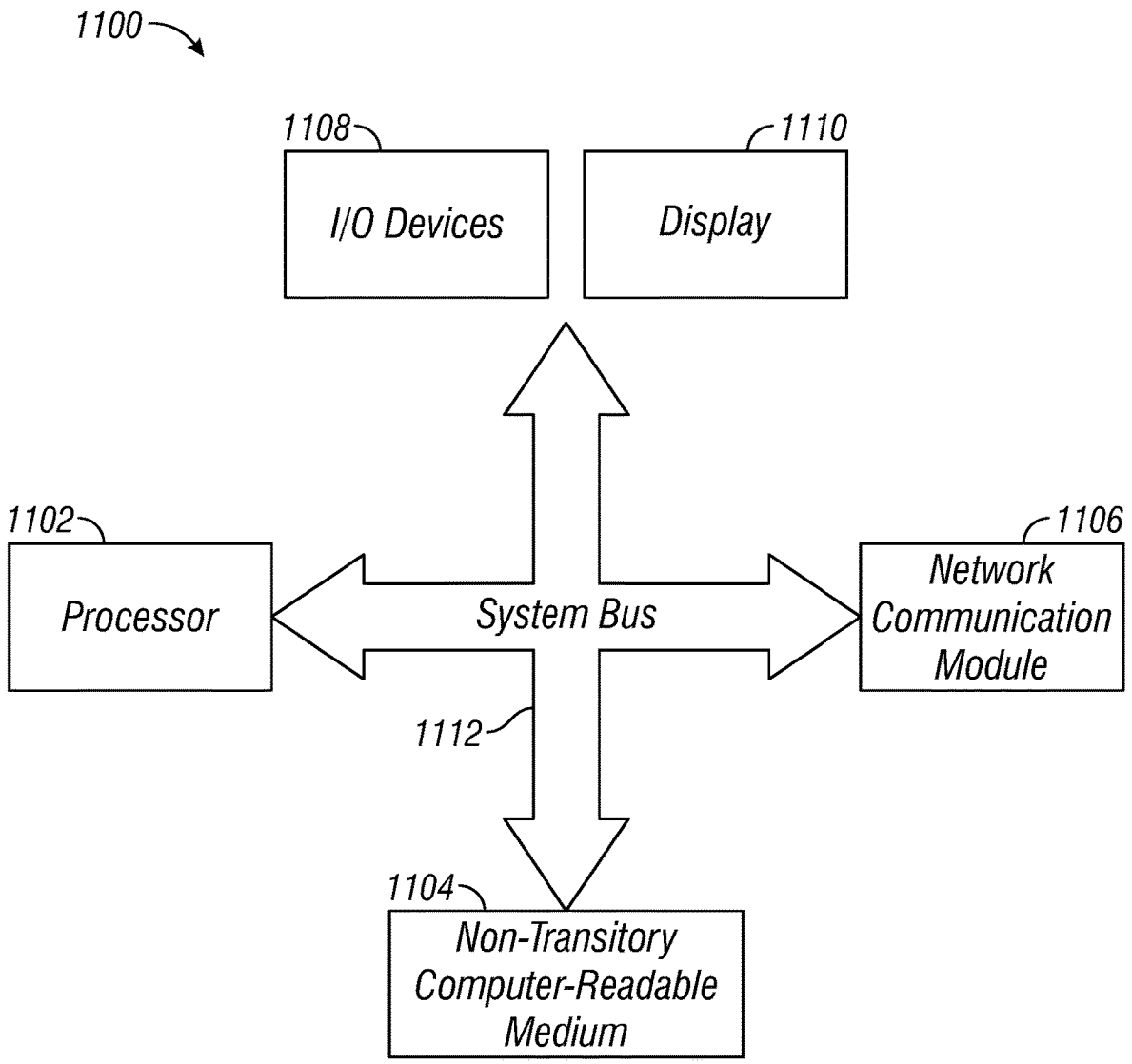
FIG. 11 is a block diagram of a controller, according to one or more embodiments.

FIG. 11 is a block diagram of a controller 1100 that can be used to control the blower of an HVAC system, such as in the control systems described above. The controller 1100 includes at least one processor 1102, a non-transitory computer readable medium 1104, an optional network communication module 1106, optional input/output devices 1108, a data storage drive or device, and an optional display 1110 all interconnected via a system bus 1112. In at least one embodiment, the input/output device 1108 and the display 1110 may be combined into a single device, such as a touch-screen display. Software instructions executable by the processor 1102 for implementing software instructions stored within the controller 1100 in accordance with the illustrative embodiments described herein, may be stored in the non-transitory computer readable medium 1104 or some other non-transitory computer-readable medium.

The controller 1100 may be realized by, for example, a computer. The computer that constitutes the controller 1100 may include a control calculation device and a storage device. For the control calculation device, a processor such as a CPU or a GPU may be used. The control calculation device reads a program that is stored in the data storage device and performs a predetermined computing processing operation in accordance with the program. Further, the control calculation device writes a calculated result to the storage device and reads information stored in the storage device in accordance with the program. Alternatively, the controller 1100 may be formed by using an integrated circuit (IC) that can perform control similar to the control that is performed by using a CPU. Here, IC includes, for example, LSI (large-scale integrated circuit), ASIC (application-specific integrated circuit), a gate array, and FPGA (field programmable gate array).

Although not explicitly shown in FIG. 11, it will be recognized that the controller 1100 may be connected to one or more public and/or private networks via appropriate network connections. It will also be recognized that software instructions may also be loaded into the non-transitory computer readable medium 1104 from an appropriate storage media or via wired or wireless means.

Certain terms are used throughout the description and claims to refer to particular features or components. As one skilled in the art will appreciate, different persons may refer to the same feature or component by different names. This document does not intend to distinguish between components or features that differ in name but not function.

For the embodiments and examples above, a non-transitory computer readable medium can comprise instructions stored thereon, which, when performed by a machine, cause the machine to perform operations, the operations comprising one or more features similar or identical to features of methods and techniques described above. The physical structures of such instructions may be operated on by one or more processors. A system to implement the described algorithm may also include an electronic apparatus and a communications unit. The system may also include a bus, where the bus provides electrical conductivity among the components of the system. The bus can include an address bus, a data bus, and a control bus, each independently configured. The bus can also use common conductive lines for providing one or more of address, data, or control, the use of which can be regulated by the one or more processors. The bus can be configured such that the components of the system can be distributed. The bus may also be arranged as part of a communication network allowing communication with control sites situated remotely from system.

In various embodiments of the system, peripheral devices such as displays, additional storage memory, and/or other control devices that may operate in conjunction with the one or more processors and/or the memory modules. The peripheral devices can be arranged to operate in conjunction with display unit(s) with instructions stored in the memory module to implement the user interface to manage the display of the anomalies. Such a user interface can be operated in conjunction with the communications unit and the bus. Various components of the system can be integrated such that processing identical to or similar to the processing schemes discussed with respect to various embodiments herein can be performed.

While compositions and methods are described herein in terms of "comprising" various components or steps, the compositions and methods can also "consist essentially of" or "consist of" the various components and steps.

Unless otherwise indicated, all numbers expressing quantities are to be understood as being modified in all instances by the term "about" or "approximately". Accordingly, unless indicated to the contrary, the numerical parameters are approximations that may vary depending upon the desired properties sought to be obtained by the embodiments of the present disclosure.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A heating, ventilation, and air-conditioning (HVAC) system that circulates a refrigerant, comprising:

an outdoor heat exchanger (HX) comprising a length and a projection of a distance between top and bottom ends of the outdoor HX in a plane;

outdoor fans, each outdoor fan comprising a center, a diameter, and a perimeter; and a compressor operable to circulate the refrigerant through a refrigerant circuit including the outdoor HX;

wherein the outdoor fans are arranged in a plane parallel with the length of the outdoor HX to satisfy at least one of the following conditions: a ratio of a distance between the centers of the outdoor fans to a largest diameter of the fans is from 1.3 to 2.1, a ratio of the largest diameter of the fans to a length the projection is from 0.5 to 0.95, or a ratio of a distance between the perimeter of a fan and an edge of the outdoor HX and the length of the outdoor HX is from 0.05 to 0.3.

2. The system of claim 1, wherein the HVAC system is a package rooftop HVAC unit.

3. The system of claim 1, further comprising a pair of outdoor HXs arranged in a V-shape.

4. The system of claim 1, wherein the outdoor HX is planar.

5. The system of claim 1, wherein the outdoor HX is formed in a non-planar configuration.

6. The system of claim 1, further comprising an indoor HX and an expansion device operable to control flow of the refrigerant through the refrigerant circuit.

7. The system of claim 1, wherein the outdoor fans are identical to each other.

8. The system of claim 1, wherein at least one of the outdoor fans has at least one parameter different from at least one other of the outdoor fans, including at least one of diameter, number of blades, blade design, fan motor size, or fan type.

9. The system of claim 1, further comprising two, three, four, or six outdoor fans arranged in an in-plane configuration.

10. The system of claim 1, further comprising three or five outdoor fans arranged in a staggered configuration.

11. The system of claim 1, further comprising a controller operable to control the operation of the compressor and the outdoor fans.

12. The system of claim 11, wherein the HVAC system comprises a variable refrigerant flow system and the outdoor fans comprise variable speed fans.

13. A method of operating a heating, ventilation, and air conditioning (HVAC) system, comprising:

operating a compressor to circulate a refrigerant through refrigerant circuit including an outdoor heat exchanger (HX) comprising a length and a projection of a distance between top and bottom ends of the outdoor HX in a plane; and moving air across the outdoor HX by operating outdoor fans, each outdoor fan comprising a center, a diameter, and a perimeter;

wherein the outdoor fans are arranged in a plane parallel with the length of the outdoor HX to satisfy at least one of the following conditions: a ratio of a distance between the centers of the outdoor fans to a largest diameter of the fans is from 1.3 to 2.1, a ratio of the largest diameter of the fans to a length of the projection is from 0.5 to 0.95, or a ratio of a distance between the perimeter of a fan and an edge of the outdoor HX and the length of the outdoor HX is from 0.05 to 0.3.

14. The method of claim 13, further comprising a pair of planar outdoor HXs arranged in a V-shape.

15. The method of claim 13, wherein the outdoor HX is planar.

16. The method of claim 13, wherein the outdoor HX is formed in a non-planar configuration.

17. The method of claim 13, further comprising operating an indoor HX and an expansion device to control flow of the refrigerant through the refrigerant circuit.

18. The method of claim 13, wherein the outdoor fans are identical to each other.

19. The method of claim 13, wherein at least one of the outdoor fans has at least one parameter different from at least one other of the outdoor fans, including at least one of diameter, number of blades, blade design, fan motor size, or fan type.

20. The method of claim 13, further comprising two, three, four, or six outdoor fans arranged in an in-plane configuration.

21. The method of claim 13, further comprising three or five outdoor fans arranged in a staggered configuration.

22. The method of claim 13, further comprising controlling the operation of the compressor and the outdoor fans using a controller.

23. The method of claim 22, wherein the HVAC system comprises a variable refrigerant flow system and the outdoor fans comprise variable speed fans.

24. An outdoor unit for a heating, ventilation, and air-conditioning (HVAC) system that circulates a refrigerant, comprising:

an outdoor heat exchanger (HX) comprising a length and a projection of a distance between top and bottom ends of the outdoor HX in a plane;

outdoor fans, each outdoor fan comprising a center, a diameter, and a perimeter; and a compressor operable to circulate the refrigerant through a refrigerant circuit including the outdoor HX;

wherein the outdoor fans are arranged in a plane parallel with the length of the outdoor HX to satisfy at least one of the following conditions: a ratio of a distance between the centers of the outdoor fans to a largest diameter of the fans is from 1.3 to 2.1, a ratio of the largest diameter of the fans to a length of the projection is from 0.5 to 0.95, or a ratio of a distance between the perimeter of a fan and an edge of the outdoor HX and the length of the outdoor HX is from 0.05 to 0.3.

25. The outdoor unit of claim 24, further comprising a pair of planar outdoor HXs arranged in a V-shape.

26. The outdoor unit of claim 24, further comprising two, three, four, or six outdoor fans arranged in an in-plane configuration.

27. The outdoor unit of claim 24, further comprising three or five outdoor fans arranged in a staggered configuration.

* * * * *